US006648582B2

(12) United States Patent
Mayer et al.

(10) Patent No.: US 6,648,582 B2
(45) Date of Patent: Nov. 18, 2003

(54) BOOM LOCK

(75) Inventors: Peter John Mayer, Cuba City, WI (US); Douglas S. States, Dubuque, IA (US); David E. Lemm, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/106,624

(22) Filed: Mar. 26, 2002

(65) Prior Publication Data

US 2003/0185661 A1 Oct. 2, 2003

(51) Int. Cl.[7] ..... B66F 9/00
(52) U.S. Cl. ..... 414/694; 414/687
(58) Field of Search ..... 414/694, 687, 414/695.5–695.8

(56) References Cited

U.S. PATENT DOCUMENTS 4,225,282 A 9/1980 Nordstrom et al. ..... 414/694
4,260,321 A 4/1981 Beauchamp et al. ..... 414/694
4,887,938 A * 12/1989 Menke ..... 414/694
5,064,339 A 11/1991 Ahlers ..... 414/687
5,967,737 A 10/1999 Kraske et al. ..... 414/694

* cited by examiner

*Primary Examiner*—Donald W. Underwood

(57) ABSTRACT

A boom lock having an actuator and a hook assembly locks a boom of a work vehicle to a swing frame. The hook assembly is pivotally coupled to the swing frame and comprises two hooks and an actuator plate. The hook assembly has a locked position wherein the hooks contact a catch assembly located on the boom and an unlocked position wherein the hooks do not engage the catch assembly. The hook assembly is moved between these two positions by the actuator. The actuator is provided with a fork having an upper tine that contacts the top surface of the actuator plate and a lower tine that contacts the bottom surface of the actuator plate. The actuator is pivotally mounted to the vehicle by a bracket and is provided with a latch for latching the actuator in a first or second position.

19 Claims, 4 Drawing Sheets

BOOM LOCK

FIELD OF THE INVENTION

The present invention is directed to a boom lock for locking the boom of a backhoe or excavator to the swing frame during transporting and craning operations.

BACKGROUND OF THE INVENTION

Excavators and backhoes are widely used in the construction industry for doing excavation work. They are typically provided with a pivotal boom which is attached to the vehicle by a swing frame. The swing frame is provided with a vertical pivot for pivoting the backhoe about a vertical axis relative to the vehicle. The boom of the backhoe is joined to the swing frame by a horizontal pivot and can be pivoted relative to the swing frame about a horizontal axis. A dipperstick is pivotally mounted to the boom. The positions of the swing frame relative to the vehicle, the boom relative to the swing frame, and the dipperstick relative to the boom are controlled by hydraulic cylinders. Typically, a bucket is pivotally attached to the end of the dipperstick remote from the boom. A hydraulic cylinder pivotally attached to the dipperstick is used to position the bucket relative to the dipperstick through a bucket linkage.

During transporting operations, as the vehicle is being moved from one job site to another, the boom is locked relative to the swing frame, and the swing frame locked relative to the vehicle. During craning operations, the boom is locked relative to the frame, but the swing frame is not locked relative to the vehicle. Various examples of boom locks are disclosed in U.S. Pat. Nos. 4,225,282, 4,260,321 and U.S. Pat. No. 5,064,339.

SUMMARY OF THE INVENTION

It is an object of the present invention to provide a boom lock having an actuator fork with upper and lower tines that locks and releases the boom lock.

A work vehicle having a boom that is pivotally mounted to a swing frame is provided with a boom lock for locking the boom to the swing frame. A hook assembly is pivotally mounted to the swing frame and is provided with two downwardly oriented hooks that are joined by an enlarged actuator plate. The enlarged actuator plate has a top surface and a bottom surface. The hooks are designed to engage a catch assembly located on the boom locking the boom to the swing frame. The catch assembly comprises a pin that extends transversely across the width of the boom. The hook assembly has a locked position where the hooks engage the catch assembly, and an unlocked position where the hooks do not engage the catch assembly.

The position of the hook assembly is controlled by an actuator having a fork with upper and lower tines. The upper tine has a downwardly bent tip that selectively engages the upper surface of the enlarged actuator plate in response to movement by the actuator, thereby releasing the boom lock. The lower tine has an upwardly bent tip for engaging the lower surface of the enlarged actuator plate in response to movement by the actuator, thereby applying the lock and locking the boom to the swing frame.

The actuator is pivotally mounted to the vehicle by a bracket. The actuator is provided with an upwardly extending lever arm. A latch is pivotally mounted to the actuator. The latch having an downwardly facing detent for engaging a catch pin on the bracket. The latch having a first position corresponding to the locked position of the hook assembly, and a second position corresponding to the unlocked position of the hook assembly. The downwardly facing detent defining the second position of the latch. The latch is biased downwardly into contact with the catch pin by a spring extending between the bracket and the latch.

DETAILED DESCRIPTION

Figure 1:
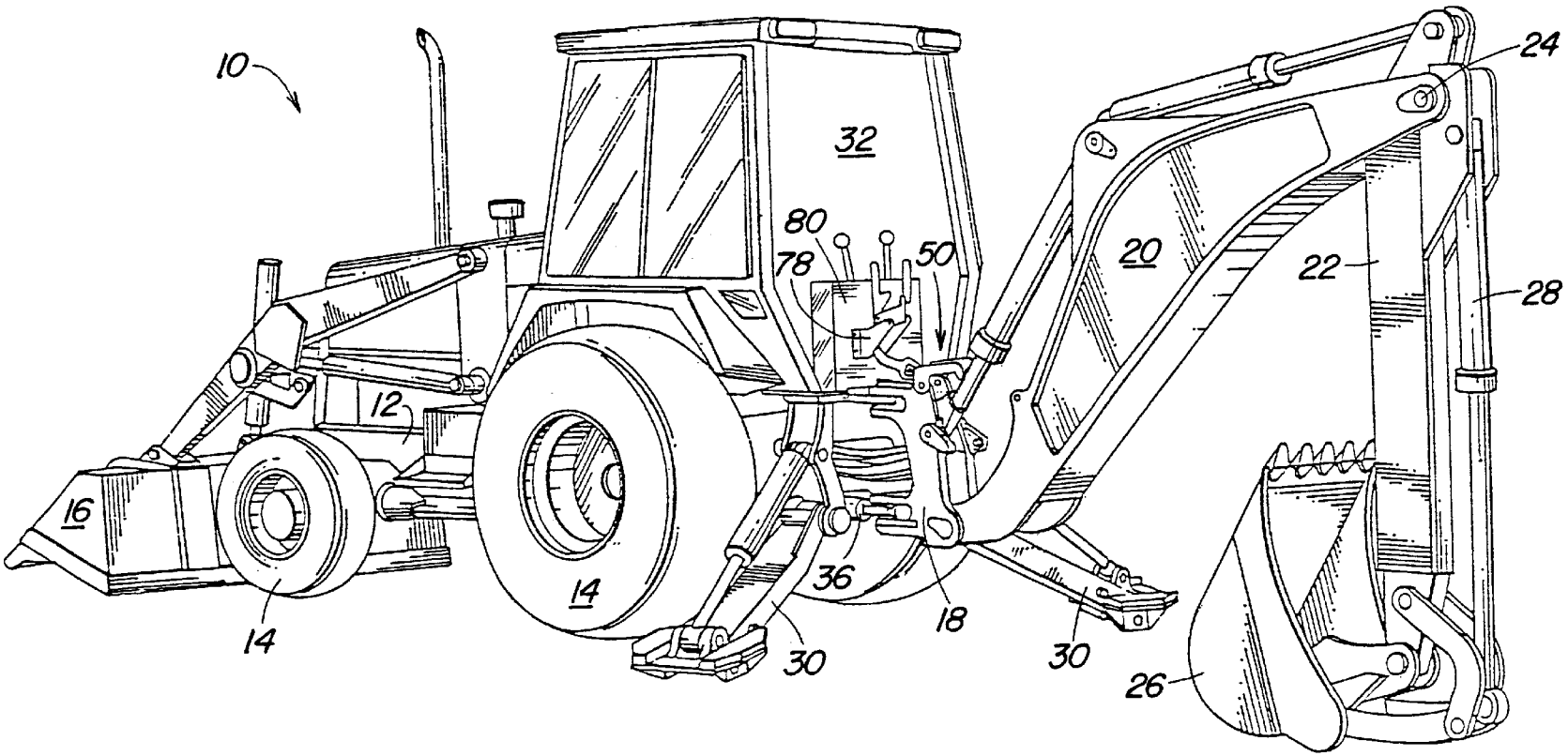
FIG. 1 is a rear perspective view of a backhoe loader.
Figure 2:
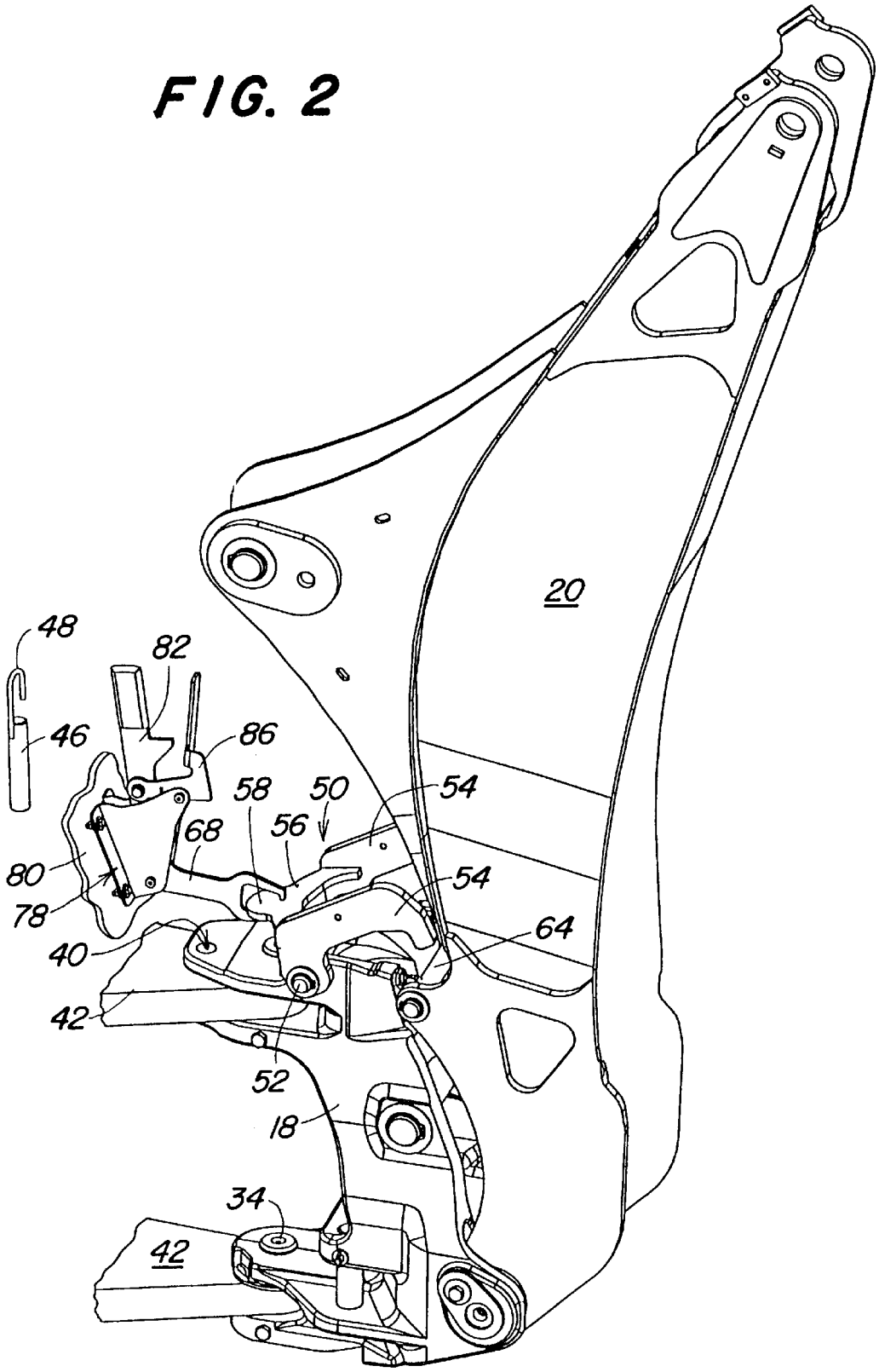
FIG. 2 is a rear perspective view of the boom and boom lock wherein the boom is oriented straight behind the work vehicle.
Figure 3:
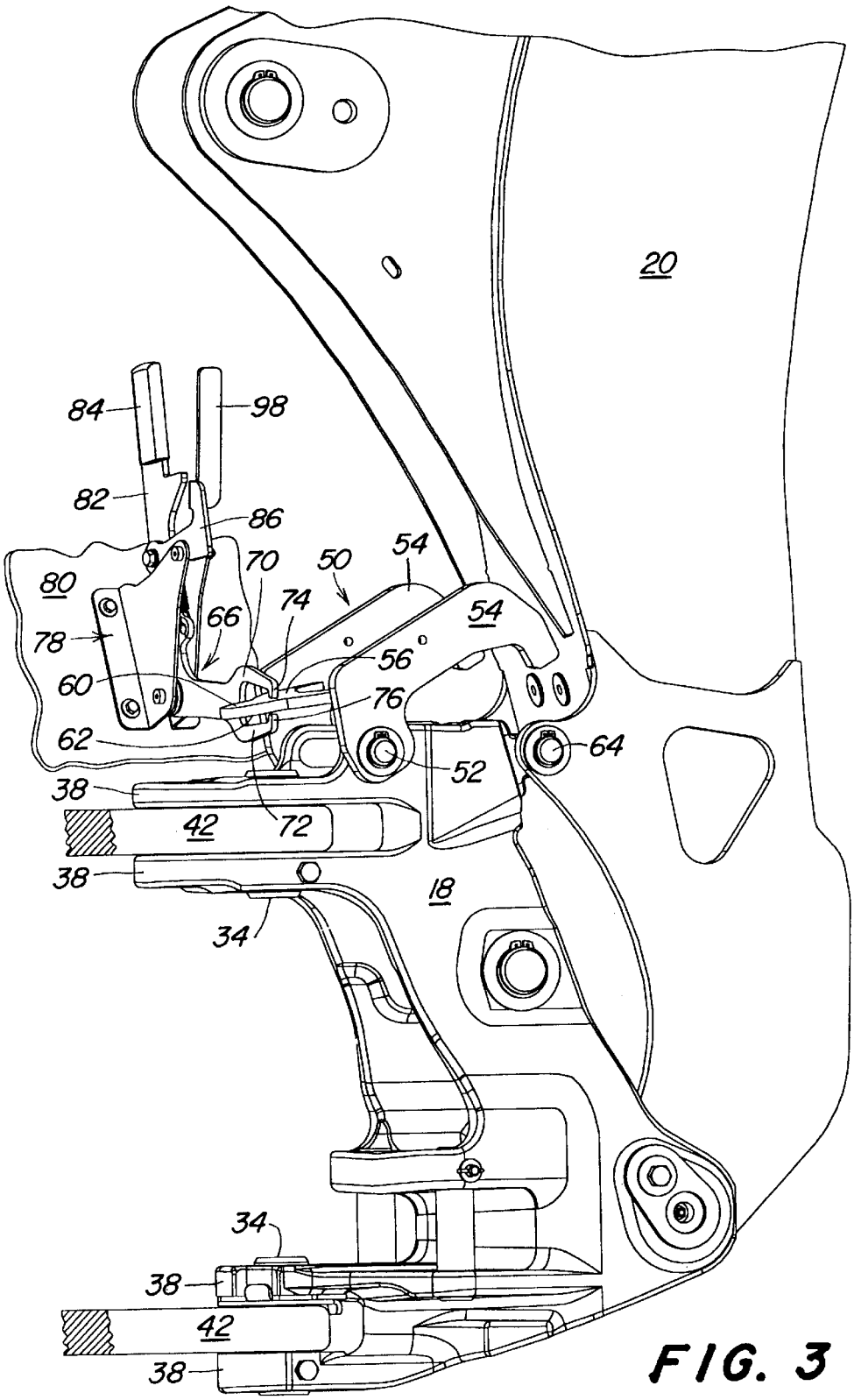
FIG. 3 is an enlarged rear perspective view of the boom and boom lock wherein the boom is rotated with respect to the work vehicle.
Figure 4:
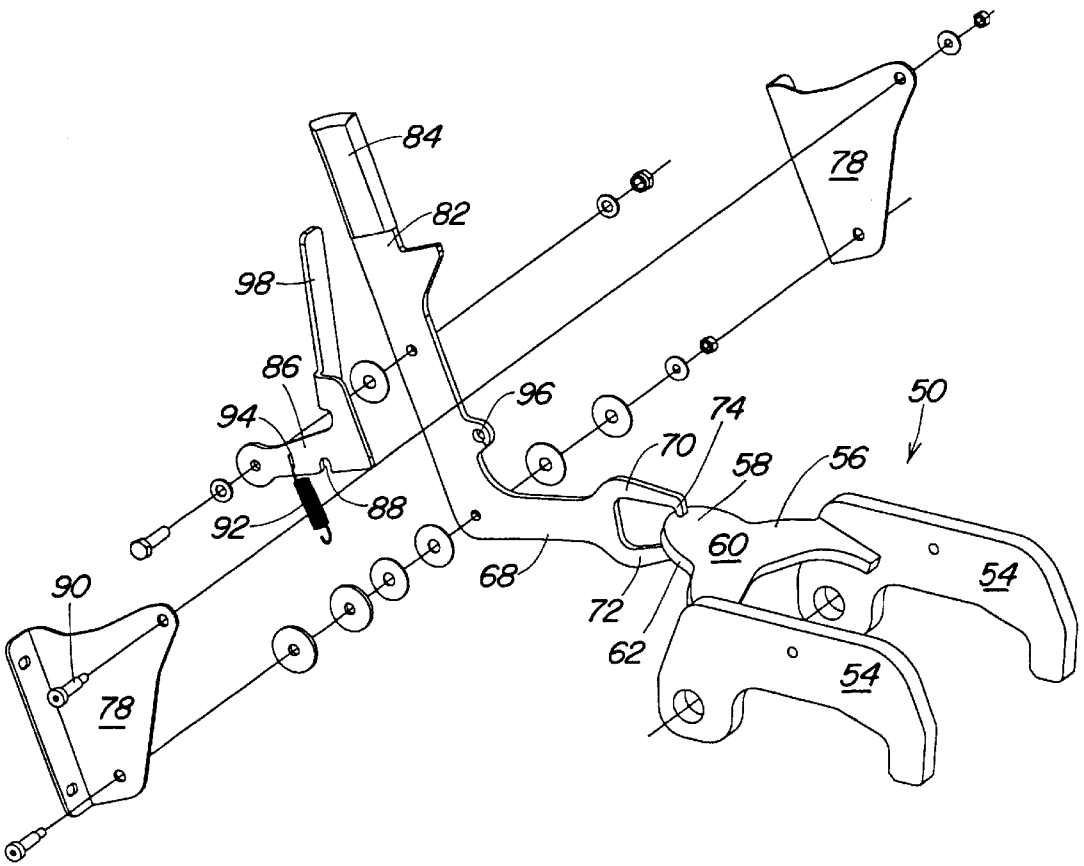
FIG. 4 is an exploded view of the boom lock.

FIG. 1 illustrates a work vehicle, such as a backhoe loader 10, having a frame 12 to which are mounted ground engaging wheels 14 for supporting and propelling the frame. Although the current invention is illustrated as being mounted on a wheeled work vehicle, it can also be mounted on a crawler work vehicle or other suitable work vehicles. In addition, the boom lock of the present invention could be used on an excavator. The backhoe loader 10 is provided with a loader bucket 16 having a suitable loader bucket linkage for manipulating the loader bucket relative to the frame. The rear of the vehicle frame 12 is provided with a swing frame 18. A boom 20 is pivotally coupled to the swing frame 18, a dipperstick 22 is pivotally connected to the boom at pivot 24 and a bucket 26 is pivotally connected to the dipperstick 22. A bucket actuating hydraulic cylinder 28 manipulates the bucket 26 through a bucket linkage. The backhoe loader is also provided with two stabilizers 30. The operation of the vehicle is controlled from either an open or closed operator's station 32.

The swing frame 18 is pivotally coupled to the vehicle frame 12 by a vertical swing frame pivot 34. Swing frame hydraulic cylinder 36 pivots the swing frame 18 relative to the vehicle frame 12 about a vertical swing frame axis defined by the swing frame pivot 34. The swing frame 18 is provided with two pairs of forwardly projecting vertically arranged portions 38. The topmost pair of portions 38 is provided with vertical pin receiving apertures 40. Two rearwardly extending portions 42 of the vehicle frame 12 are sandwiched between the pairs of forwardly extending portions 38 to which the swing frame 18 is pivotally coupled by swing frame pivot 34. The topmost portion 42 is also provided with a vertical aperture, not shown. The vertical aperture on the rearwardly extending portion 42 is aligned with apertures 40 when the swing frame 18 is in a selected locking position on the vehicle frame 12 as defined by the position of the aligned apertures. When the apertures are aligned, a removable pin 46 having a handle 48 can be inserted into the apertures for locking the swing frame 18 relative to the vehicle frame 12.

Lock assembly 50 is pivotally mounted to the swing frame 18 by lock assembly pivot 52. The lock assembly 50 comprises an integral piece having two downwardly oriented hooks 54 joined by an actuator plate 56. The actuator plate 56 has an enlarged portion 58 located above the swing frame pivot axis defined by the swing frame pivots 34. The enlarged portion 58 has a top surface 60 and a bottom surface 62. The hooks 54 are designed to engage a catch assembly 64 when the hook assembly is moved into its locked position. The catch assembly 64 comprises a transversely extending pin that extends across the width of the boom 20.

The hook assembly 50 is moved from a locked downwardly tilted position to its unlocked upwardly tilted position by actuator 66. The actuator 66 comprises a fork 68 having an upper tine 70 and a lower tine 72. The upper tine 70 is provided with a downwardly bent tip 74 that selectively engages the top surface 60 of the enlarged portion 58 of the hook assembly 50. Similarly, the lower tine 72 is provided with an upwardly bent tip 76 that engages the bottom surface 62 of the enlarged portion 58 of the hook assembly 50. The downwardly bent tip 74 is used to push the actuator plate 56 downwardly driving the hooks 54 upwardly to release the boom 20 from the swing frame 18. The upwardly bent tip 76 is used to push the actuator plate 56 upwardly pushing the actuator plate 56 upward and the hooks 54 downwardly to lock the boom 20 to the swing frame 18.

The actuator 66 is pivotally attached to a bracket 78 that is mounted to the frame 12 of the vehicle 10. In the illustrated embodiment, the bracket 78 is mounted to the backhoe control console 80. The actuator 66 is provided with an upwardly extending lever arm 82 having a hand grip 84. A latch 86 is pivotally attached to the lever arm 82. The latch 86 is provided with a downwardly facing detent 88 which engages catch pin 90 mounted to the bracket. The latch 86 has a first position and a second position. The first position corresponds to the locked position of the hook assembly 50, and the second position corresponds to the unlocked position of the hook assembly 50. The second position is defined by the downwardly facing detent 88 engaging the catch pin 90. The latch is held in this position by a spring 92 downwardly biasing the downwardly facing detent 88 into engagement with the catch pin 90. The spring extends between aperture 94 on the latch 86 and lever arm aperture 96. The actuator 66 is pivoted on the bracket 78. The latch 86 is provided with an upwardly extending handle 98 that is parallel to the lever arm 82 for releasing the latch 86.

Having described the preferred embodiment, it will become apparent that various modifications can be made without departing from the scope of the invention as defined in the accompanying claims.

What is claimed is:

1. A vehicle having a boom, the vehicle having a swing frame for pivotally mounting the boom on the vehicle on a vertical pivot about a vertical swing frame pivot axis, the vehicle being provided with an operator's station from which the operation of the boom is controlled, the boom being swingably mounted on the swing frame on a horizontal boom pivot for movement between a transport position and selected working positions, and a boom hydraulic cylinder operative between the boom and the swing frame for positioning the boom, and a locking device for selectively locking the boom to the swing frame so the boom is prevented from rotating about the boom pivot when in its transport position, the locking device comprising:

a hook assembly pivotally coupled to the swing frame about a hook assembly pivot, the hook assembly having a hook and an actuator plate, the actuator plate having a top surface and a bottom surface, the hook assembly having a locked position and an unlocked position;

a catch assembly mounted to the boom which is engaged by the hook when the hook assembly is in its locked position;

an actuator is mounted to the frame of a vehicle, the actuator comprising a fork having a top tine and a bottom tine, the top tine selectively engaging the top surface of the actuator plate and the bottom tine selectively engaging the bottom surface of the actuator plate for moving the hook assembly from its locked position to its unlocked position and from its unlocked position to its locked position.

2. The vehicle as defined by claim 1 wherein the top tine of the fork has a downwardly bent tip that contacts the top surface of the actuator plate and generally corresponds to the vertical swing frame pivot axis and the bottom tine of the fork has an upwardly bent tip that contacts the bottom surface of the actuator plate and generally corresponds to the vertical swing frame pivot axis.

3. The vehicle as defined by claim 2 wherein the actuator is pivotally mounted to the frame of the vehicle by a bracket.

4. The vehicle as defined by claim 3 wherein the actuator is also provided with an upwardly extending lever arm, the lever arm is provided with a latch that engages a catch, the catch being located on the bracket, the latch having a first position and a second position, the first position corresponding to the locked position of the hook assembly and the second position corresponding to the unlocked position of the hook assembly.

5. The vehicle as defined by claim 4 wherein the second position of the latch is defined by a downwardly facing detent formed on the latch that engages the catch to latch the hook assembly in its unlocked position.

6. The vehicle as defined by claim 5 wherein a spring extends between the latch and the actuator for biasing the latch downwardly.

7. The vehicle as defined by claim 6 wherein the catch assembly comprises a catch pin that extends transversely across the boom.

8. The vehicle as defined by claim 7 wherein the hook comprises a downwardly oriented hook that engages the catch pin when the hook is in its locked position.

9. The vehicle as defined by claim 8 wherein the hook assembly is provided with a second downwardly oriented hook that engages the catch pin when the hook is in its locked position.

10. The vehicle as defined by claim 8 wherein the actuator plate and the two downwardly oriented hooks are a single integral hook assembly.

11. A work vehicle for performing a work operation, the work vehicle comprising:

a frame;

an operator's station mounted to the frame from which the operation of the boom is controlled;

ground engaging assembly coupled to the frame for supporting the propelling the frame;

a swing frame pivotally coupled to the frame by a vertical swing frame pivot, defining a vertical swing frame axis;

a boom is pivotally coupled to the swing frame by a boom pivot for movement between a transport position and selected working positions;

a boom hydraulic cylinder operative between the boom and the swing frame for positioning the boom; and a locking device for selectively locking the boom to the swing frame so the boom is prevented from rotating about the boom pivot when in its transport position, the locking device is provided with two hooks that are pivotally coupled to the swing frame, an actuator plate extends between the two hooks, the actuator plate having a top surface and a bottom surface, the hooks having a locked position and an unlocked position, a catch assembly is mounted to the boom which is engaged by the hooks when the hooks are in their locked position, an actuator is mounted to the frame of a vehicle, the actuator comprising a fork having a top tine and a bottom tine, the top tine selectively engaging the top surface of the actuator plate and the bottom tine selectively engaging the bottom surface of the actuator plate for moving the hooks from their locked position to their unlocked position and from their unlocked position to their locked position.

12. The work vehicle as defined by claim 11 wherein the top tine of the fork has a downwardly bent tip that contacts the top surface of the actuator plate and generally corresponds to the vertical swing frame pivot axis and the bottom tine of the fork has an upwardly bent tip that contacts the bottom surface of the actuator plate and generally corresponds to the vertical swing frame pivot axis.

13. The work vehicle as defined by claim 12 wherein the actuator is pivotally mounted to the frame of the vehicle by a bracket.

14. The work vehicle as defined by claim 13 wherein the actuator is also provided with an upwardly extending lever arm, the lever arm is provided with a latch that engages a catch, the catch being located on the bracket, the latch having a first position and a second position, the first position corresponding to the locked position of the hooks and the second position corresponding to the unlocked position of the hooks.

15. The work vehicle as defined by claim 14 wherein the second position of the latch is defined by a downwardly facing detent formed on the latch that engages the catch to latch the hooks in their unlocked position.

16. The work vehicle as defined by claim 15 wherein a spring extends between the latch and the actuator for biasing the latch downwardly.

17. The work vehicle as defined by claim 16 wherein the catch assembly comprises a catch pin that extends transversely across the boom.

18. The work vehicle as defined by claim 17 wherein the two hooks are downwardly oriented and engage the catch pin when the hooks are in their locked position.

19. The work vehicle as defined by claim 18 wherein the actuator plate and the two downwardly oriented hooks are a single integral assembly.

* * * * *